US005788139A

United States Patent [19]

Sikora

[11] Patent Number: 5,788,139

[45] Date of Patent: Aug. 4, 1998

[54] STITCHING MACHINE HEAD AND WIRE CASSETTE THEREFOR

[75] Inventor: Larry A. Sikora, Racine, Wis.

[73] Assignee: Cass Strapping Corporation, Sterling Heights, Mich.

[21] Appl. No.: 628,946

[22] Filed: Apr. 8, 1996

[51] Int. Cl.[6] ..... B27F 7/23

[52] U.S. Cl. ..... 227/82; 227/84; 227/88; 227/97; 242/562; 242/563.1

[58] Field of Search ..... 227/82, 84, 88, 227/89, 90, 91, 86, 93, 97; 242/563.1, 562, 558, 566

[56] References Cited

U.S. PATENT DOCUMENTS

| | | | |
|---|---|---|---|
| 592,453 | 10/1897 | Sisum . | |
| 1,934,104 | 11/1933 | Svensson . | |
| 1,991,263 | 2/1935 | Stewart . | |
| 2,523,571 | 9/1950 | Humm, Jr. . | |
| 2,636,168 | 4/1953 | Wright et al. | 227/84 |
| 2,640,659 | 6/1953 | Biko et al. . | |
| 2,697,829 | 12/1954 | Winkler . | |
| 2,873,927 | 2/1959 | McDonald . | |
| 2,957,638 | 10/1960 | Schiller et al. . | |
| 2,960,280 | 11/1960 | Connelly et al. . | |
| 3,006,567 | 10/1961 | Collins . | |
| 3,642,187 | 2/1972 | Barland | 227/84 |
| 3,982,402 | 9/1976 | Lang et al. . | |
| 4,053,094 | 10/1977 | Males . | |
| 4,085,492 | 4/1978 | Stange | 227/82 |
| 4,386,744 | 6/1983 | Higbee . | |
| 4,505,415 | 3/1985 | Gruen . | |
| 4,531,682 | 7/1985 | Schroder et al. . | |
| 4,542,844 | 9/1985 | Olesen et al. . | |
| 4,570,870 | 2/1986 | Ito . | |
| 4,722,467 | 2/1988 | Kunka et al. . | |
| 4,807,829 | 2/1989 | Zollinger . | |
| 4,898,314 | 2/1990 | Stroh . | |
| 5,147,080 | 9/1992 | Assink et al. . | |
| 5,150,826 | 9/1992 | Logtens . | |

FOREIGN PATENT DOCUMENTS 659363 10/1991 United Kingdom .

*Primary Examiner*—Scott A. Smith
*Attorney, Agent, or Firm*—Emrich & Dithmar

[57] ABSTRACT

A supply wire cassette is removably mounted on the face plate of a wire stitching machine head. The cassette carries a rotatable reel of wire from which wire is unreeled over a flexible, resilient brake lever through a check pawl and a guide tube, which guides the unreeled wire along an arcuate, wire-straightening path to an outlet at a cutter on the head. A wire holder is removably mounted on the cassette housing and holds the free end thereof in position at the outlet until the cassette is mounted on the face plate to ensure that the wire passes through the feed mechanism of the head. Actuation of the feed mechanism withdraws wire from the cassette, pivoting the brake lever to unbrake the supply reel. When a predetermined length of unreeled wire accumulates in the cassette housing, the brake lever is biased back into braking engagement with the reel. A sensor including a switch removably mounted in the cassette housing indicates when the supply reel is nearly empty.

13 Claims, 4 Drawing Sheets

STITCHING MACHINE HEAD AND WIRE CASSETTE THEREFOR

BACKGROUND OF THE INVENTION

1. Field of the Invention

The invention relates to wire stitching machines and the stitching heads for such machines. In particular, the invention relates to apparatus for resupplying wire to the stitching machine head when the wire supply becomes exhausted.

2. Description of the Prior Art

Continuous wire stitching machines and, in particular, stitching heads therefor, operate to cut a predetermined length of wire from the end of a continuous wire supply, thereafter forming the cut length of wire into a U-shaped staple, driving the staple through an associated workpiece, and then clinching the legs of the staple.

Most of the details of the construction and operation of the stitching machine head, per se, are not critical to the present invention. These stitching devices are relatively complex and can take a number of detailed forms. A device with which the apparatus of the present invention finds utility, without limitation thereto, is described in FIGS. 15–19 of U.S. Pat. No. 2,697,829, the disclosure of which is incorporated herein by reference.

In the stitching machine of U.S. Pat. No. 2,697,829, a vertically reciprocating bender bar or former operates to bend a short severed length of wire into a U-shaped staple. A vertically reciprocating driver bar then drives the formed staple down through the workpiece against a clincher, which bends the staple legs up against the opposite side of the workpiece. During a single down-up reciprocation cycle of the stitching mechanism, a wire gripping and feeding mechanism grips the supply wire and feeds it vertically downwardly through a cutter and into a rotatable wire holder. The cutter then cuts the predetermined length of wire disposed in the holder from the supply, and the wire gripping and feeding mechanism releases the wire and then retracts upwardly along the wire to the start position. During this retraction motion, the wire holder is rotated to shift the cut length wire from a vertical to a horizontal position. During the downstroke of each down-up cycle the staple forming and driving mechanism forms the length of wire which was cut during the previous cycle into a U-shaped staple and drives it through the workpiece against the clincher.

The wire is fed to the feed mechanism along a face plate of the stitching machine head through a series of wire straightening devices and an anti-backup detent which prevents retrograde movement of the wire toward the supply reel. The position of the face plate can be manually adjusted relative to the wire gripping and feeding mechanism to feed different lengths of wire, thereby to form different size staples.

The wire supply is wound under tension on an open spool. When the spool is exhausted it is discarded and a new spool is mounted in place on a support. The leading end of the new wire supply must then be manually threaded through the wire straightening and anti-backup devices, then through the wire gripping and feeding mechanism to the cutter. The operator must then cut the wire to length so that the cut end is at the proper position for the beginning of a stitching cycle. If this is not carefully done and the straighteners are properly adjusted, the wire will not be fed accurately into the cutter and will cause misfeeds and dropped stitches. Furthermore, the operator must be very careful not to release the end of the wire while it is being threaded into the stitching machine head, otherwise the tension-wound wire will backlash and rapidly unreel and all the unreeled wire will have to be discarded.

When the operator desires to shift the face plate to adjust the predetermined length of wire fed for each staple, it is necessary for him to loosen the face plate by rotating an associated screw with a suitable tool, such as a wrench or the like, then move the face plate the desired distance and retighten the face plate screw with the tool.

SUMMARY OF THE INVENTION

It is a general object of the present invention to provide an improved stitching machine head and wire supply apparatus therefor, which avoid the disadvantages of prior stitching machine heads while affording additional structural and operating advantages.

An important feature of the invention is the provision of a wire stitching machine head of the type set forth which eliminates the need for manual threading of the leading end of a new wire supply into the stitching machine head.

In connection with the foregoing feature, a further feature of the invention is the provision of a wire supply cassette which is removably mountable on the stitching machine head to automatically place the new wire supply into proper position for stitching operation.

A further feature of the invention is the provision of a stitching machine head of the type set forth which permits simple manual adjustment of the length of the wire fed for each staple, without the use of tools.

Yet another feature of the invention is the provision of a wire supply cassette for use with a stitching machine head of the type set forth.

These and other features of the invention are attained by providing in a wire stitching machine head having a face plate along which wire is fed from a continuous supply, a wire feed mechanism for feeding a predetermined length of wire along the face plate, a wire cutter for severing the predetermined length of wire from the supply, a wire former and driver for forming the severed length of wire into a staple and driving the staple through an associated workpiece, and a length adjuster for moving the face plate relative to the wire feed mechanism to vary the predetermined length, the improvement comprising: a wire cassette including a substantially closed housing having a discharge portion, a supply reel of wire rotatably mounted in the housing, guide structure in the housing for guiding the wire from the reel to the discharge portion, and support structure for releasably mounting the cassette on the face plate in a mounting condition with the discharge portion disposed for supplying wire to the wire feed mechanism.

Further features of the invention are attained by providing a stitching wire cassette comprising: a substantially closed housing having a discharge portion, a supply reel of wire rotatably mounted in the housing for accommodating unreeling of wire therefrom in a dispensing direction, check structure on the housing engageable with an unreeled portion of the wire for preventing movement thereof in a direction opposite to the discharge direction, a flexible and resilient lever mounted in the housing for pivotal movement between braking and release conditions, and bias means resiliently urging the lever to the braking condition thereof wherein the lever is engageable with the reel for preventing rotation thereof, the lever having a control end engageable with the unreeled portion of the wire and being deflectable in response to dispensing withdrawal of unreeled wire from the discharge portion, the lever being responsive to a predetermined deflection of the control end for pivoting to the release condition wherein the lever is out of engagement with the reel to permit rotation thereof for unreeling of wire therefrom.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 5B:
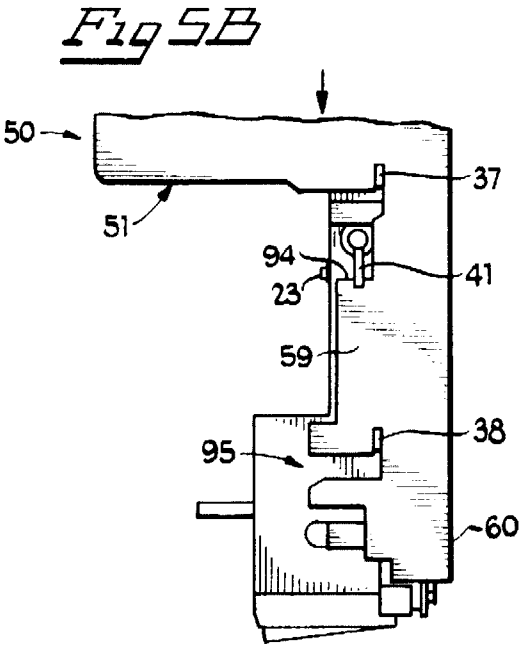
FIG. 5B is a view similar to FIG. 5A, showing the wire supply cassette mounted on the stitching machine head and indicating the direction of the second part of the mounting movement.

Referring to FIGS. 1, 2, 5A and 10, there is illustrated a stitching machine head, generally designated by the numeral 20, in accordance with the present invention. The stitching machine head 20 is substantially the same as that disclosed in the aforementioned U.S. Pat. No. 2,697,829 and, therefore, only so much of the stitching machine head 20 will be described herein as is necessary for an understanding of the present invention.

The stitching machine head 20 has a channel-like upstanding frame 21 which carries the principal parts of the stitching machine and may be secured to an associated base (not shown) by means of a stud 22. A drive lug 23 projects from the rear end of the frame 21 and is adapted to be coupled to associated drive linkage (not shown) of the stitching machine for effecting reciprocating movement of the mechanism of the stitching machine head 20. The front of the frame 21 is covered by a face plate 25, which has a rectangular opening 26 therein through which a wire feed mechanism 27 projects forwardly. The wire feed mechanism 27 includes a fixed jaw 28 and a movable jaw 29 and is coupled to a staple forming and driving mechanism 30, which is also mounted in the frame 21 behind the face plate 25. A cutter bar 31 is mounted on the face plate 25 at the lower end of the opening 26 and carries a pair of cutters (not shown). The cutter bar 31 has a wire opening 32 formed therethrough for receiving the stitching wire and holding it while it is being cut. A bracket 33 is mounted on the frame 21 at its lower end and carries a rotatable wire holder or anvil 34, which is coupled by an elongated, leaf spring arm 35 to a rotor 36 which projects from the frame 21 through a cutout in the face plate 25. The operation of the stitching machine head 20 during a stitching cycle is substantially the same as is described above in connection with U.S. Pat. No. 2,697,829.

It is a significant aspect of the invention that the face plate 25 has a pair of laterally outwardly extending upper mounting tabs 37 and a pair of laterally outwardly extending lower mounting tabs 38. Also, there is formed through the face plate 35 adjacent to its upper end an adjustment aperture 39 (see FIG. 2) to accommodate a wire length adjusting cam 40, which is manually operable by means of a lever handle 41 which projects laterally from the left-hand side of the frame 21, as viewed in FIG. 2. Cam 40 is locked in place by a screw **40*a* which, when loosened, permits movement of the cam 40. The cam 40 is engageable with the face plate 25 at the periphery of the aperture 39 so that, when the cam 40 is raised or lowered by means of the handle 41 and associated linkage, it will move the face plate 25 a slight distance upwardly or downwardly, depending upon the direction of rotation of the handle 41. This face plate movement serves the same function as in the aforementioned U.S. Pat. No. 2,697,829, i.e., adjustment of the length of staple wire fed during each cycle which, in turn, serves to adjust the length of the legs of the formed staple. However, the adjusting mechanism including the cam 40 and the handle 41** permits a simply manual adjustment operation without the use of tools.

A fundamental aspect of the invention is the provision of a wire supply cassette 50 which carries a supply of stitching wire and is removably mountable on the stitching machine head 20. Referring now also to FIGS. 3–10, the cassette 50 has a two-part housing 51 including mateable side members 52 and 53 which may be fixedly secured together by suitable fasteners (not shown). When thus joined, the side members 52 and 53 cooperate to define an upper storage portion 54 forming a wire reel chamber 55 (FIGS. 6 and 7), and an elongated discharge portion or neck 56. The discharge neck 56 is generally channel-shaped, being open at the rear, and including a pair of side walls 58 and 59, respectively formed on the side members 52 and 53 and a front wall 60 defined by mating front wall portions of the side members 52 and 53. The thus-formed front wall 60 has a bottom edge 61 in which is formed an arcuate recess 62. Formed through the front wall 60 adjacent to the lower end of the discharge neck 56 is a rectangular aperture 63.

Figure 4:
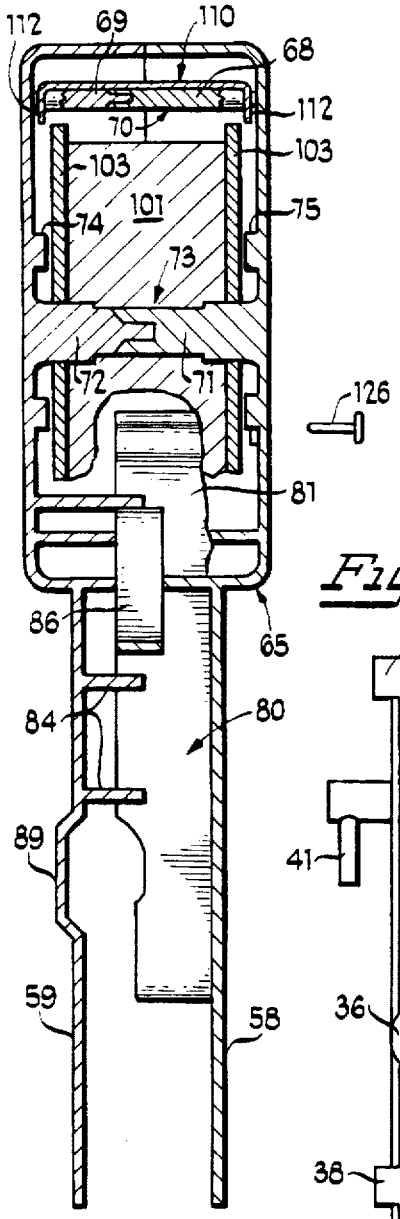
FIG. 4 is a sectional view of the wire supply cassette taken generally along the line 4—4 in FIG. 3, and with the spool lock pins shown removed.
Figure 6:
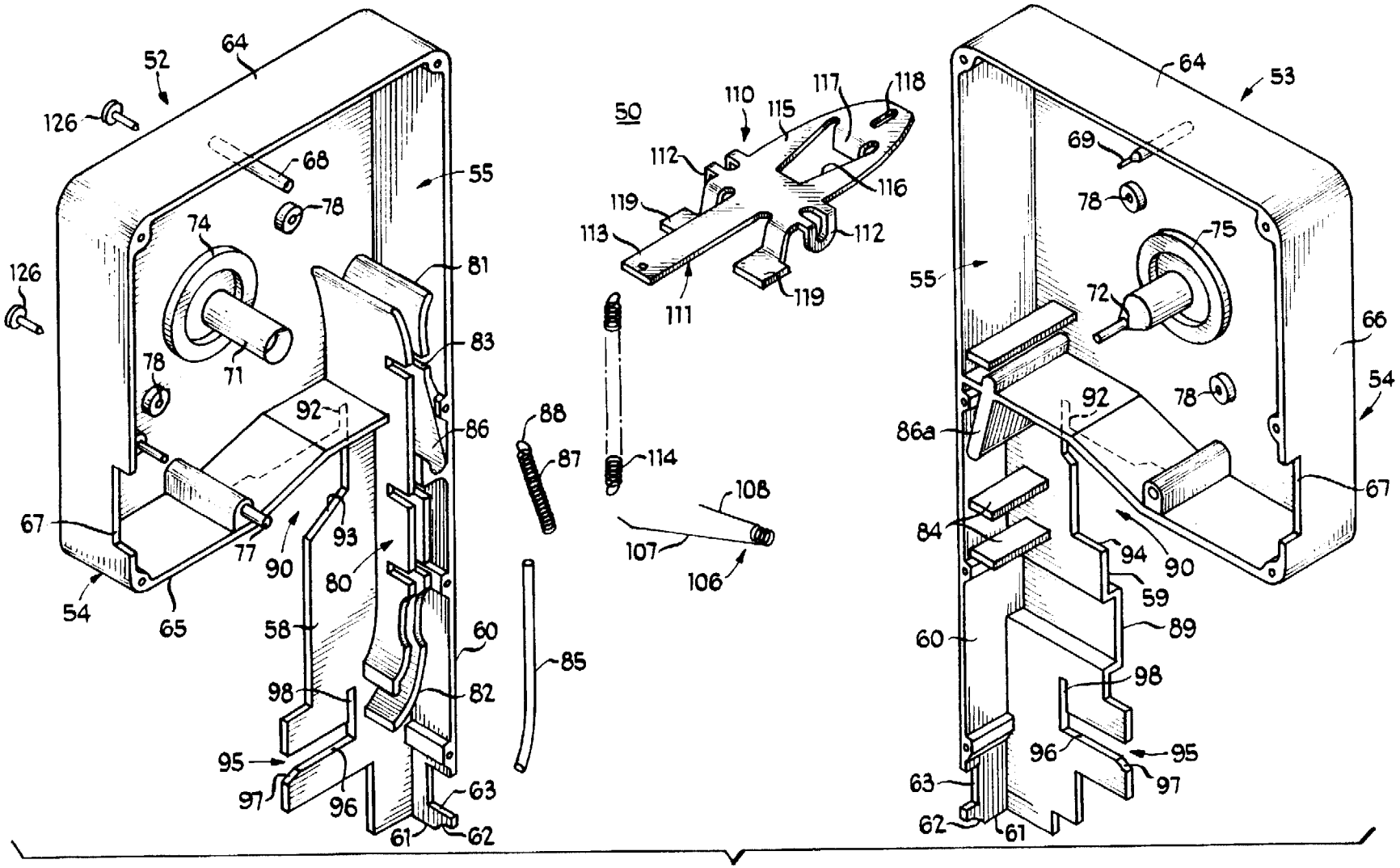
FIG. 6 is an enlarged, exploded, perspective view of the wire supply cassette of FIG. 1 with the wire spool removed.

The upper or storage portion 54 of the housing 51 is of generally box-like rectangular configuration, having a top wall 64, a bottom wall 65 and a rear wall 66, and is closed at the front thereof by the upper end of the front wall 60. A rectangular aperture 67 is formed through the rear wall 66 adjacent to the lower end thereof, the storage portion 54 being closed at the sides thereof by large rectangular extensions of the side walls 58 and 59. Respectively unitary with the side walls 58 and 59 substantially adjacent to the upper end of the storage portion 54, are a female stub shaft member 68 and a male stub shaft member 69, which cooperate when the housing halves are assembled to define a shaft 70 (see FIGS. 3 and 4). Similarly, there are also unitary with the side walls 58 and 59 of the storage portion 54 male and female stub axle members 71 and 72, which cooperate when the housing parts are joined together to define an axle 73. Respectively projecting laterally inwardly from the side walls 58 and 59, respectively coaxially with the axle members 71 and 72, are annular hub bases 74 and 75 (FIGS. 4 and 6). Similarly, shafts 76 and 77 are formed by male members on the housing side member 52, which are respectively received in complementary sockets on the housing side member 53. Formed through the upper ends of the side walls 58 and 59 at spaced apart locations in the storage portion 54 are pin holes 78 for a purpose to be explained more fully below.

Referring in particular to FIGS. 3, 6, 7, 8 and 10, there is unitarily formed on the housing side member 52 an elongated guide chute 80, which is fundamentally formed by a pair of spaced-apart walls which diverge at their upper ends to define a funnel neck 81, and are curved at their lower ends to define an arcuate end 82. The guide chute 80 is unitary with the side wall 58 and spaced a slight distance rearwardly of the front wall 60, with the funnel neck 81 projecting into the reel chamber 55. Formed in the free side edges of the guide chute 80 are longitudinally spaced grooves or notches 83, which respectively receive therein retaining webs 84 unitary with the side wall 59 of the other housing side member 53. The webs 84 have a length less than the depth of the guide chute 80 for cooperation therewith to define a narrow channel for the stitching wire, as will be explained more fully below, and preventing the wire from escaping laterally from the guide chute 80. Fitted into the guide chute 80 at the lower end thereof is a guide tube 85, which may be formed of a suitable flexible plastic material. Also, integrally molded in the housing side member 52 between the guide chute 80 and the front wall 60 is a spur chamber 86, which communicates with the guide chute 80 and receives therein a helical compression spring 87 and a check pin 88, the spring 87 resiliently urging the pin 88 upwardly and rearwardly against the rear wall of the guide chute 80. A block **86*a* (FIG. 6), molded on the side member 53 fits into the chamber 86 to retain the spring 87 and pin 88** therein.

The side walls 58 and 59 of the discharge neck 56, respectively have formed therein upper notches 90 adjacent to the storage portion 54, each notch 90 having a wide, generally horizontally extending entry portion 91 and a narrow, vertically extending portion 92. The notch 90 on the side wall 58 has a downwardly and rearwardly inclined lower edge 93. The side wall 59 is cut away, as at 94, below the notch 90 to accommodate the handle 41 of the wire length adjustment cam 40 (see FIG. 5B). Lower notches 95 are similarly formed on the side walls 58 and 59 adjacent to the lower ends thereof, each having a relatively wide, horizontally extending entry portion 96 with a beveled lower edge 97 and a narrow, vertically extending portion 98. The notches 90 and 95 are designed to respectively receive the face plate mounting tabs 37 and 38, as will be explained more fully below.

A wire supply reel or spool 100 is mounted in the reel chamber 55 of the cassette 50. Referring to FIGS. 3, 4, 7 and 9, the reel 100 carries a tension-wound coil of continuous wire 101 wound on a hub 102 between annular flanges 103 in a known manner. Formed through each of the flanges 103 adjacent to the outer edge thereof are two or more pin holes 104. The reel hub 102 is rotatably mounted on the axle 73 for free rotational movement within the reel chamber 55. When thus mounted, the hub bases 74 and 75 are, respectively, disposed for engagement with the reel flanges 103 to limit lateral movement of the reel 100.

The cassette 50 is provided with a reel-sensing apparatus 105, which includes a leaf spring 106 torsion wound on the shaft 77 and having tangentially outwardly extending leaves 107 and 108. The leaf 108 bears against the outer periphery of the coil of wire 101, while the leaf 107 engages a microswitch 109, the housing **109*a* for which is received in the aperture 67 in the housing 51 (FIG. 7**).

Also disposed in the reel chamber 55 is a reel brake assembly 110, which includes an elongated, flexible, resilient lever 111, which may be unitarily formed of spring steel or other suitable flexible and resilient material. More specifically, the lever 111 is preferably formed from a thin sheet of material having a pair of pivot ears 112 respectively bent downwardly from opposite sides thereof and having apertures therethrough for receiving the shaft 70 to afford a pivotal mounting of the lever 111. The lever 111 has an anchor end 113, which is coupled to one end of a helical tension spring 114, the other end of which is anchored to the shaft 76. The lever 111 also has a forward or feed end 115 having an aperture 116 formed therethrough and defining a convex bearing surface 117, which curves downwardly through the aperture 116. A narrow slot 118 is formed through the forward end of the feed end 115 forwardly of the convex bearing surface 117. A pair of brake feet 119 are, respectively, formed on opposite sides of the anchor end 113 and depend therefrom for engagement, respectively, with the flanges 103 of the reel 100. If desired, a suitable friction material may be provided on the feet 119 to enhance frictional engagement with the reel 100.

Figure 3:
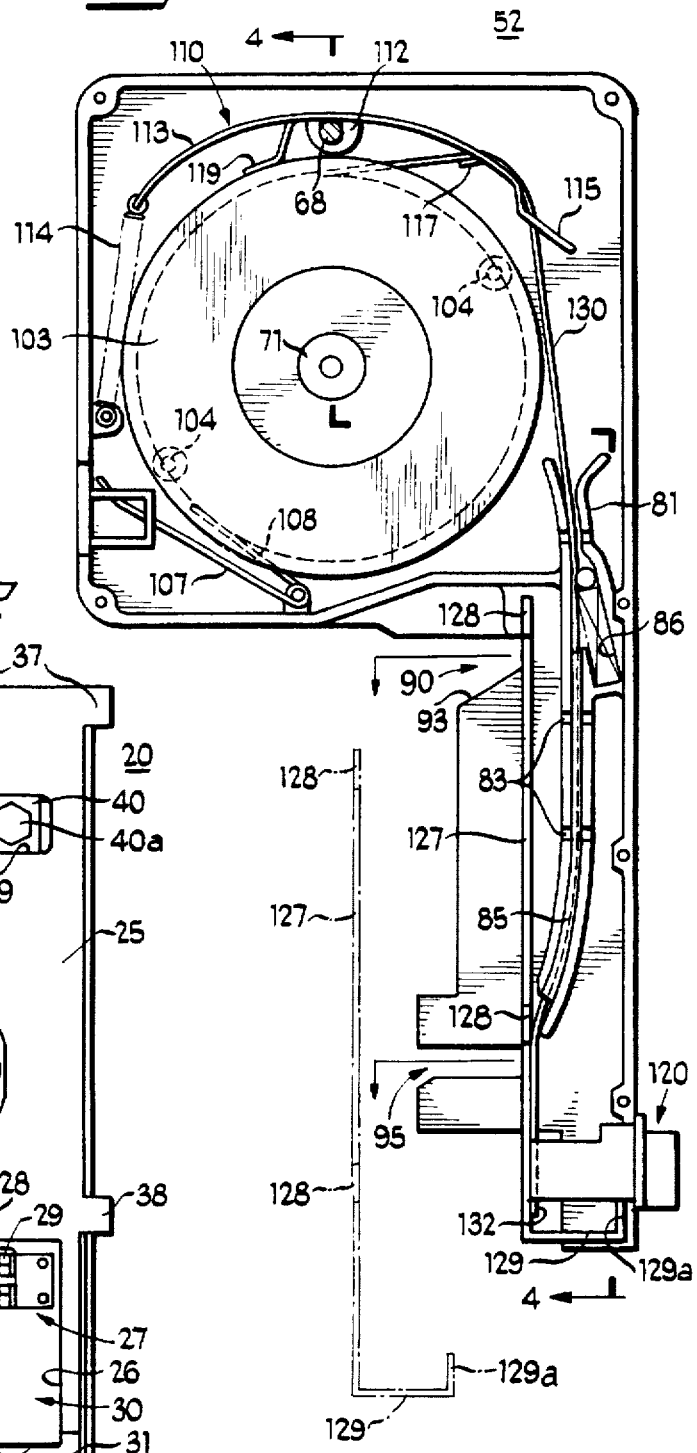
FIG. 3 is an enlarged, side elevational view of the wire supply cassette of FIG. 1, with the right-hand half thereof (as viewed in FIG. 1) removed to show the internal construction, and illustrating removal of the protective shield.
Figure 2:
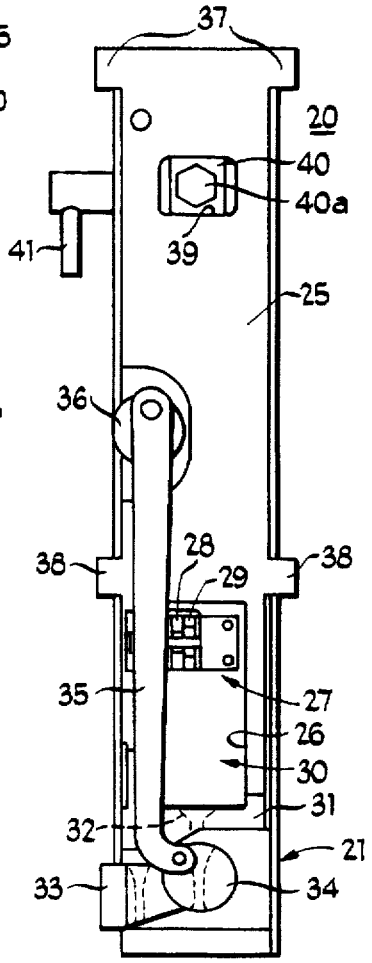
FIG. 2 is an enlarged, front elevational view of the stitching machine head of FIG. 1.

When the cassette 50 is being loaded, the wire reel 100 is fitted over the female end 71 of the axle 73, against the hub base 74, as illustrated in FIG. 3. Then wire is unreeled from the reel 100 to form an unreeled wire portion 130, with the part thereof disposed within the reel chamber 55 constituting an accumulated portion 131.

Figure 7:
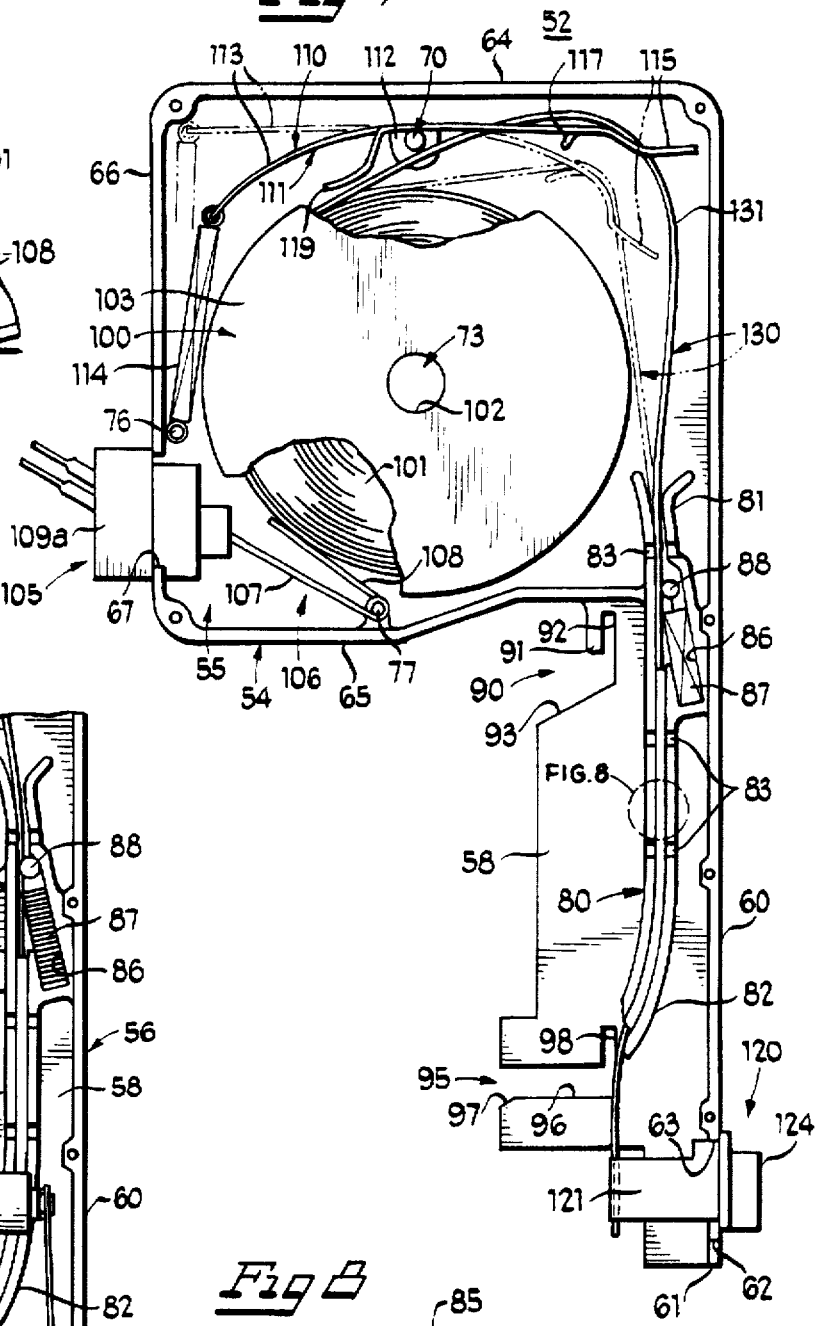
FIG. 7 is a view similar to FIG. 3, with the reel empty sensing switch mounted in place and illustrating different positions of the reel brake assembly, with portions of the reel broken away.
Figure 10:
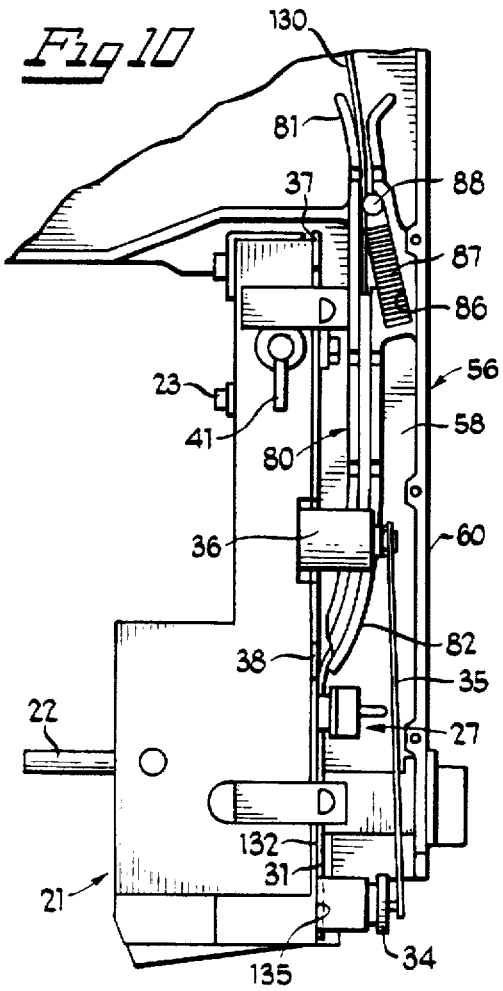
FIG. 10 is an enlarged, fragmentary, side elevational view similar to FIG. 5B, with portions of the wire supply cassette removed.
Figure 8:
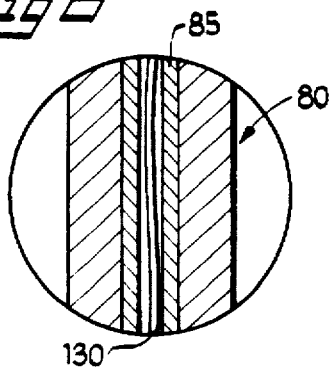
FIG. 8 is a further enlarged, fragmentary view of a portion of the wire guide structure of the cassette of FIG. 7.

More specifically, in operation, it will be appreciated that the bias spring 114 resiliently urges the lever 111 to a normal braking position, illustrated in solid line in FIGS. 3 and 7, wherein the brake feet 119 are in braking frictional engagement with the flanges 103 of the reel 100. The lever 111 is pivoted to a release position in response to withdrawal of wire from the cassette 50, as will be explained in greater detail below.

Figure 11B:
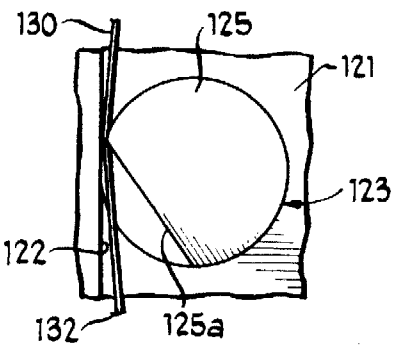
FIGS. 11A and 11B are further enlarged, fragmentary, rear elevational views of the wire holder of the wire supply cassette, respectively in its wire-releasing and wire-holding positions.
Figure 11A:
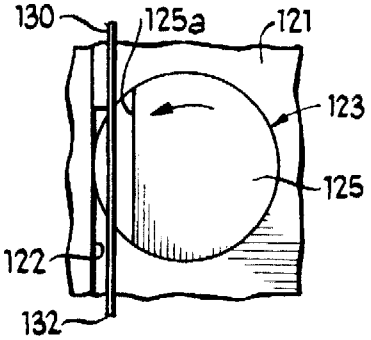

Referring now also to FIGS. 11A and 11B, the cassette 50 is provided with a wire holder 120, which includes a generally rectangular housing 121 receivable in the aperture 63 in the front wall 60 (FIG. 6) and defining a vertical bearing wall or shoulder 122 (FIGS. 11A and B). Rotatably mounted in the housing 121 is a cylindrical cam pin 123 having an enlarged head or handle 124 at its outer end which projects forwardly of the front wall 60 of the cassette 50. The cam pin 123 has an inner cam end 125 cut away at one side to define a shoulder 125*a* which extends across a chord of the pin end. The cam pin 123 is dimensioned and positioned in the housing 121 so that its outer cylindrical surface is substantially tangent to the plane of the bearing wall 122, which bearing wall preferably has a depth substantially equal to the depth of the shoulder 125*a* on the pin 123.

In operation, it can be seen from FIG. 11A that, when the shoulder 125*a* is aligned parallel to the bearing wall 122 it cooperates therewith to define therebetween a channel which is substantially wider than the thickness of the stitching wire. Initially, when the cassette 50 is loaded, the leading end 132 of the wire from the reel 100 is fed upwardly through the aperture 116 in the lever 111, over the convex bearing surface 117 and then back downwardly through the slot 118 and thence into the guide chute 80. The end 132 is then threaded down through the chute 80 and, in particular, through the guide tube 85, and then downwardly through the channel between the bearing wall 122 and the shoulder 125*a* of the wire holder 120, as illustrated in FIG. 11A, until the leading end 132 is disposed a predetermined distance below the wire holder 120. The cam pin 123 is then manually rotated by manipulation of the handle 124 to the position illustrated in FIG. 11B, wherein the cylindrical outer surface of the cam pin 123 cooperates with the bearing wall 122 to securely wedge and grip the wire 130 therebetween, locking it in place. This will hold the unreeled wire portion 130 in a fixed position within the cassette 50 until the cassette 50 is mounted for use on the associated stitching machine head 20.

During the threading and locking of the unreeled wire 130 as described above, the reel 100 is rotated in an unreeling direction a distance sufficient to bring the pin holes 104 thereof respectively into alignment with the pin holes 78 in the housing side members 52 and 53, whereupon reel lock pins 126 are inserted through the aligned holes to lock the reel against further rotation. This prevents excess unreeling of wire within the reel chamber 55 during storage and transit of the cassette 50.

It will be appreciated that the above-described wire threading and reel locking functions are performed before the two housing side members 52 and 53 are secured together. After the side members 52 and 53 have been secured together to complete the assembly of the cassette 50, a retainer plate 125, which may be formed of cardboard or other suitable inexpensive disposable material, is mounted in place to further protect the unreeled wire 130 during storage and shipment. More particularly, referring to FIG. 3, the retainer plate 127 comprises an enlongated rectangular member provided at the upper end thereof and adjacent to the lower end thereof with laterally outwardly extending tabs 128. Unitary with the plate 127 at its lower end is a forwardly projecting foot 129 which is, in turn, unitary at its distal end with an upstanding lip 129*a*. The tabs 128 are dimensioned and arranged to respectively fit in the notches 90 and 95 formed in the cassette side walls 58 and 59. Thus, for mounting the retainer plate 127 in place, the tabs 128 are respectively aligned with the horizontal entry portions 91 and 96 of the notches 90 and 95 and then pushed forwardly until the retainer plate 127 is against the inner end of the wire holder 120. Then the retainer plate 127 is moved upwardly, moving the tabs 128 into the vertical portions 92 and 98 of the notches 90 and 95 to the mounting position illustrated in solid line in FIG. 3, wherein the lip 129*a* bears against the underside of the wire holder 120. Thus, it will be appreciated that the retainer plate 127 forms a removable rear and bottom wall of the discharge neck 56 of the cassette 50 to completely enclose and protect the unreeled portion of wire 130 held therein.

Figure 5A:
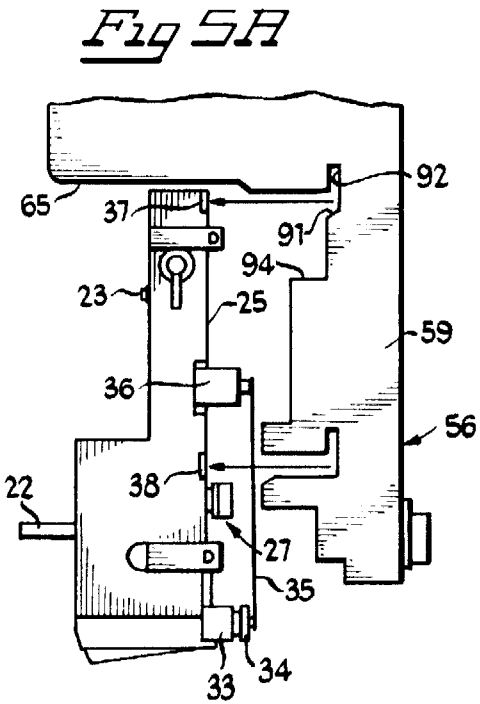
FIG. 5A is a fragmentary side elevational view of the wire supply cassette of FIG. 1, and indicating the direction of the first part of a two-part mounting movement.
Figure 1:
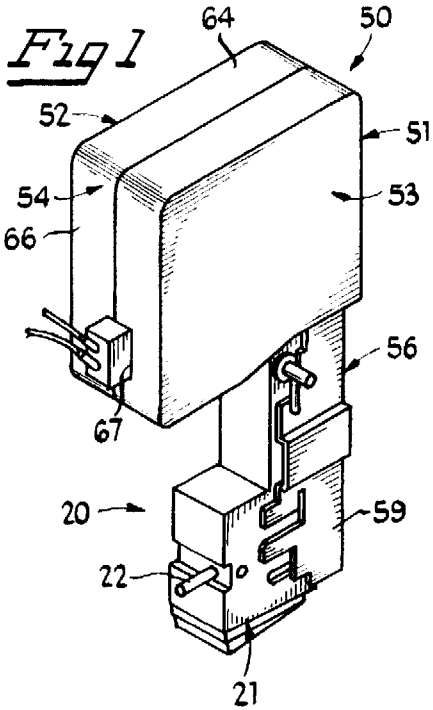
FIG. 1 is a perspective view of a stitching machine head carrying a wire supply cassette in accordance with the present invention.

The operation of the stitching machine head 20 and the cassette 50 will now be described in detail. Referring in particular to FIGS. 5A and 5B, when it is desired to mount the cassette 50 on the stitching machine head 20 to provide the head with a new supply of stitching wire, the wire feed mechanism 27 is first retracted to its raised or retracted position shown in FIGS. 2 and 10, with the jaws 28 and 29 open. The retainer plate 127 is then removed from the cassette 50 by moving it downwardly and then rearwardly out of engagement with the notches 90 and 95. Then, the cassette 50 is positioned in front of the stitching machine head 20, as illustrated in FIG. 5A, with the face plate upper mounting tabs 37 respectively aligned with the horizontal entry portions 91 of the upper notches 90 of the cassette side walls 58 and 59, and with the face plate lower mounting tabs 38 respectively aligned with the horizontal entry portions 96 of the lower notches 95 on the cassette side walls 58 and 59. The cassette 50 is then pushed rearwardly, in the direction of the arrows of FIG. 5A, with the mounting tabs 37 and 38 being respectively received into the notch entry portions 91 and 96 until the tabs bottom at the forward ends of those notches, at which point the cassette is moved downwardly in the direction of the arrow in FIG. 5B, to position the mounting tabs 37 and 38 into the vertical portions 92 and 98 of the notches 90 and 95. Thus, the cassette 50 is essentially hung on the mounting tabs 37 and 38 and is held in position thereon by gravity. It will be appreciated that, in thus mounting the cassette 50, the cutaway portion 94 of the upper notch 90 in the side wall 59 accommodates the handle 41 of the wire length adjustment cam 40, the bulge 89 in the side wall 59 accommodates the portion of the rotor 36 which projects laterally beyond the side wall of the head frame 21, and the arcuate recess 62 in the lower end of the front wall 60 of the discharge neck 56 exposes the wire holder or anvil 34.

The discharge neck 56 of the cassette 50 is dimensioned and arranged so that the unreeled wire portion 130 which extends between the lower end of the guide chute 80 and the wire holder 120 fits between the open jaws 28 and 29 of the wire feed mechanism 27 when the cassette 50 is disposed in its mounted position. After the cassette 50 has been mounted in place on the head 20, the wire holder 120 is no longer needed and can be removed from the cassette 50. Thus, the cam pin 123 is first rotated to its release position illustrated in FIG. 11A, and then the entire housing 121 is pulled forwardly out of the discharge neck 56. Preferably, the wire holder 120 will be retained in a convenient place in case it is later needed to re-grip the wire in the cassette 50 in case the cassette 50 needs to be removed for some reason, such as repair or maintenance to the stitching machine head 20.

Figure 9:
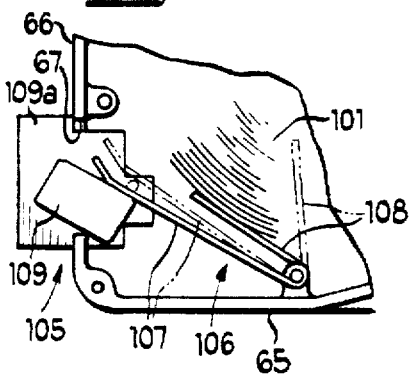
FIG. 9 is a fragmentary view of a portion of the cassette of FIG. 7, illustrating operation of the reel empty sensing apparatus.

Next, the reel lock pins 126 are removed to release the reel 100, and the microswitch housing 109*a* of the reel-sensing apparatus 105 is mounted in place in the aperture 67 of the cassette 50, as illustrated in FIGS. 7 and 9, so that the spring leaf 107 depresses the actuator button of the microswitch 109. The stitching machine head 20 is now ready for use. In this regard, it will be appreciated that, when the cassette 50 is disposed in its mounted position illustrated in FIG. 5B, the free end 132 of the unreeled wire portion 130 will be positioned in the opening 32 of the cutter bar 31, substantially at the severance plane of the cutter mechanism, i.e., in the proper position for the beginning of a staple forming cycle.

During the next cycle of the stitching machine head 20, the wire feed mechanism 27 will move upward slightly to close the jaws 28 and 29 to grip the wire 130 and will then pull the gripped wire downwardly, feeding a predetermined length of wire into and through the wire holder or anvil 34 and thereby withdrawing the unreeled wire portion 130 from the discharge neck 56 of the cassette 50. Referring in particular to FIGS. 3 and 7, as wire is withdrawn from the cassette 50 the feed end 115 of the lever 111 is deflected downwardly to the broken-line position illustrated in FIG. 7, taking up any slack which may have been formed in the accumulated wire portion 131 within the reel chamber 55. Continued withdrawal of the wire will eventually pivot the lever 111 about the axis of the shaft 70 in a clockwise direction, as viewed in FIG. 7, lifting the brake feet 119 out of engagement with the reel 100, permitting the reel to rotate to allow additional wire to be unreeled therefrom. When sufficient slack has accumulated in the unreeled wire portion 130, the lever 111 of the wheel brake assembly 110 will pivot back to its normal braking condition under the urging of the bias spring 114. The engagement of the check pin 88 with the wire 130 prevents any retrograde movement of the wire back up into the reel chamber 55 when the wire feed mechanism 27 releases the wire during its retraction stroke. The curvature of the guide chute 80 and the guide tube 85 are designed so that they will serve to straightened the wire being unreeled within the cassette 50, so that it will be fed accurately into the cutter bar 31. As the wire supply is consumed from the reel 100, the leaf 108 of the leaf spring 106 will gradually pivot in a clockwise direction, as viewed in FIGS. 3 and 7 and, eventually, when the reel 100 is nearly empty, the leaf 107 will also pivot clockwise, releasing the actuator pin of the microswitch 109, and actuating the associated indicator circuitry (not shown) to show that the cassette 50 is nearly empty.

When the wire supply in the cassette 50 has been exhausted, the cassette 50 is removed from the stitching machine head 20 by essentially reversing the mounting procedures described above. Thus, the microswitch housing 109*a* is removed from the cassette 50 and the cassette is then lifted and pulled forwardly out of engagement with the mounting tabs 37 and 38. Then a new cassette 50 is mounted in place in the manner described above.

It is a significant aspect of the invention that the wire supply for the stitching machine head 20 can be replenished by the use of the cassette 50 completely without the use of tools and without the need for any wire threading or trimming operations by the operator of the machine. Thus, the invention completely obviates the risk of improper straightener adjustment or accidental release of the unreeled wire end with attendant backlash. Each new cassette 50 is automatically positioned in place with the leading end 132 of the wire precisely positioned for the beginning of a stitching cycle. Furthermore the mounting of the cassette 50 does not require any changes or adjustments to the stitching machine head 20. Thus, no head components, such as the rotator operator spring or rotator need be moved or removed. Furthermore, the operator need not touch the stitching machine wire. In the event that maintenance of some sort is required, the cassette 50 can be easily removed and remounted in place at the end of a stitching cycle, without requiring any wire handling by the operator. In such an event, as was explained above, the wire holder 120 can simply be reinstalled to hold the free end 132 of the wire in place until the cassette 50 is remounted.

The cassette housing 51 may be formed of any suitable materials, but is preferably molded of a suitable plastic material.

From the foregoing, it can be seen that there has been provided an improved stitching machine head and wire supply cassette therefor, which afford simple resupply of wire to the stitching machine head without the need for any wire handling by the operator and without the use of any tools.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. In a wire stitching machine head having a face plate along which wire is fed from a continuous supply, a wire feed mechanism for feeding a predetermined length of wire along the face plate, a wire cutter for severing the predetermined length of wire from the supply, a wire former and driver for forming the severed length of wire into a staple and driving the staple through an associated workpiece, and a length adjuster for moving the face plate relative to the wire feed mechanism to vary the predetermined length, the improvement comprising: a wire cassette including a substantially closed housing having a discharge portion, a supply reel of wire rotatably mounted in the housing for accommodating unreeling of wire therefrom in a dispensing direction, guide structure in said housing for guiding the wire from the reel to the outlet, check structure on the housing engageable with an unreeled portion of the wire for preventing movement thereof in a direction opposite to the dispensing direction, a flexible and resilient lever mounted in said housing for pivotal movement between braking and release conditions, and bias means resiliently urging said lever to the braking condition thereof wherein said lever is engageable with said reel for preventing rotation thereof, said lever having a control end engageable with the unreeled portion of the wire and being deflectable in response to dispensing withdrawal of unreeled wire from said outlet, said lever being responsive to a predetermined deflection of said control end for pivoting to the release condition wherein said lever is out of engagement with the reel to permit rotation thereof for unreeling of wire therefrom; and support structure for releasably mounting said cassette on the face plate in a mounting condition with said discharge portion disposed for supplying wire to the wire feed mechanism.

2. The stitching machine head of claim 1, wherein said support structure includes mounting tabs on said face plate extending laterally outwardly therefrom, and slots on the housing of said cassette for respectively receiving said mounting tabs.

3. The stitching machine head of claim 1, wherein said length adjuster includes a cam member engageable with the face plate, and a manually-operable handle coupled to said cam member for rotation thereof to move the face plate.

4. The stitching machine head of claim 1, wherein said discharge portion has an outlet, and further comprising a wire holder carried by said housing for fixedly holding an unreeled end of the wire adjacent to the outlet.

5. The stitching machine head of claim 1, wherein said guide structure includes means defining a curved path within said housing for straightening wire unreeled from said supply reel.

6. The stitching machine head of claim 1, wherein said cassette further includes a sensor mechanism carried by said housing and engageable with the supply reel for indicating when the reel is nearly empty.

7. The stitching machine head of claim 6, wherein said sensor includes a leaf spring pivotally mounted in said housing and biased into engagement with said reel, and a switch removably mounted on said housing and engageable with said leaf spring for actuation thereby when the reel is nearly empty to provide an indication.

8. A stitching wire cassette comprising: a substantially closed housing having a discharge portion, a supply reel of wire rotatably mounted in the housing for accommodating unreeling of wire therefrom in a dispensing direction, check structure on the housing engageable with an unreeled portion of the wire for preventing movement thereof in a direction opposite to the dispensing direction, a flexible and resilient lever mounted in said housing for pivotal movement between braking and release conditions, and bias means resiliently urging said lever to the braking condition thereof wherein said lever is engageable with said reel for preventing rotation thereof, said lever having a control end engageable with the unreeled portion of the wire and being deflectable in response to dispensing withdrawal of unreeled wire from said discharge portion, said lever being responsive to a predetermined deflection of said control end for pivoting to the release condition wherein said lever is out of engagement with the reel to permit rotation thereof for unreeling of wire therefrom.

9. The cassette of claim 8, wherein said lever is of unitary one-piece construction.

10. The cassette of claim 8, wherein said lever has two openings therein receiving said wire therethrough and a convexly arcuate portion between said openings for engaging the unreeled wire.

11. The cassette of claim 8, wherein said lever includes a pair of brake feet disposed for engagement with said reel.

12. The cassette of claim 8, and further comprising a sensor mechanism carried by said housing and engageable with the supply reel for indicating when the reel is nearly empty.

13. The cassette of claim 8, wherein said housing has a hole therein, and further comprising a lock pin receivable through said hole and engageable with said reel for preventing rotation thereof.

* * * * *